US005943717A

United States Patent [19]

Alexander

[11] Patent Number: 5,943,717

[45] Date of Patent: Aug. 31, 1999

[54] BED BLANKET FOR BED

[76] Inventor: Tim Alexander, 3712 Sebren Lond Beach, Long Beach, Calif. 90808

[21] Appl. No.: 09/019,580

[22] Filed: Feb. 6, 1998

[51] Int. Cl.[6] ..... A47G 9/02

[52] U.S. Cl. ..... 5/486; 5/482

[58] Field of Search ..... 5/482, 486, 495, 5/502

[56] References Cited

U.S. PATENT DOCUMENTS

| | | | |
|---|---|---|---|
| 2,689,961 | 9/1954 | Lieberthal | 5/486 |
| 3,072,776 | 1/1963 | Quenneville | 5/486 X |
| 3,801,420 | 4/1974 | Anderson | 5/502 |
| 4,802,251 | 2/1989 | O'Dell | 5/486 X |
| 5,023,969 | 6/1991 | Nattrass | 5/486 |

*Primary Examiner*—Michael F. Trettel

[57] ABSTRACT

A bed blanket for bed is provided including a pair of blankets of fabric each having a top surface, a bottom surface, and a periphery formed therebetween. The periphery of each blanket is defined by a linear first side edge of a predetermined length, a linear top edge perpendicular with respect to the first side edge, a linear bottom edge perpendicular with respect to the first side edge, and a second side edge including a top extent perpendicular with respect to the top edge. The top extent has a length of about ¾ the predetermined length. A bottom extent of the second side edge is perpendicular with respect to the bottom edge and has a length of about ¼ the predetermined length. Also included is a pair of seams each including a thin strip secured about the entire periphery of the associated blanket. The bottom extent of the second side edge of each blanket are fixedly coupled together along an entire length thereof such that the top extent of the second side edges of the blankets overlap freely.

1 Claim, 2 Drawing Sheets

BED BLANKET FOR BED

BACKGROUND OF THE INVENTION

1. Field of the Invention

The present invention relates to a bed blanket for bed and more particularly pertains to preventing a first person in a bed from disturbing another.

2. Description of the Prior Art

The use of bed blankets is known in the prior art. More specifically, bed blankets heretofore devised and utilized for the purpose of aiding one to sleep are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,287,573; U.S. Pat. No. 5,023,969; U.S. Pat. Des. 267,696; U.S. Pat. No. 4,005,499; U.S. Pat. No. 4,069,526.

In this respect, the bed blanket for bed according to the present invention substantially departs from the conventional concepts and designs of the prior art, and in so doing provides an apparatus primarily developed for the purpose of preventing a first person in a bed from disturbing another.

Therefore, it can be appreciated that there exists a continuing need for a new and improved bed blanket for bed which can be used for preventing a first person in a bed from disturbing another. In this regard, the present invention substantially fulfills this need.

SUMMARY OF THE INVENTION

In view of the foregoing disadvantages inherent in the known types of bed blankets now present in the prior art, the present invention provides an improved bed blanket for bed. As such, the general purpose of the present invention, which will be described subsequently in greater detail, is to provide a new and improved bed blanket for bed which has all the advantages of the prior art and none of the disadvantages.

To attain this, the present invention essentially comprises a pair of blankets of fabric. Each blanket has a top surface, a bottom surface, and a periphery formed therebetween. The periphery of each blanket is defined by a linear first side edge of a predetermined length and a linear top edge perpendicular with respect to the first side edge and having a length of about ¾ the predetermined length. The periphery is further defined by a linear bottom edge perpendicular with respect to the first side edge and having a length about ½ the predetermined length. Finally, a second side edge includes a top extent perpendicular with respect to the top edge and having a length of about ¾ the predetermined length. A bottom extent of the second side edge is perpendicular with respect to the bottom edge and has a length of about ¼ the predetermined length. Extending between a bottom of the top extent and a top of the bottom extent of the second side edge is an intermediate extent of a length ¼ the predetermined length. Such intermediate extent of the second side resides in parallel with the top and bottom edges. Further provided is a pair of seams each including a thin strip. This strip is secured about the entire periphery of the associated blanket with the exception of the bottom extent of the second side edge. Preferably, the strip is folded to encompass the top surface and bottom surface of the corresponding blanket. As shown in FIG. 1, the bottom extent of the second side edge of each blanket are stitchedly coupled together along an entire length thereof. As such, the top extent of the second side edges of the blankets overlap freely.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bed blanket for bed which has all the advantages of the prior art bed blankets and none of the disadvantages.

It is another object of the present invention to provide a new and improved bed blanket for bed which may be easily and efficiently manufactured and marketed.

It is a further object of the present invention to provide a new and improved bed blanket for bed which is of a durable and reliable construction.

An even further object of the present invention is to provide a new and improved bed blanket for bed which is susceptible of a low cost of manufacture with regard to both materials and labor, and which accordingly is then susceptible of low prices of sale to the consuming public, thereby making such bed blanket for bed economically available to the buying public.

Still yet another object of the present invention is to provide a new and improved bed blanket for bed which provides in the apparatuses and methods of the prior art some of the advantages thereof, while simultaneously overcoming some of the disadvantages normally associated therewith.

Still another object of the present invention is to prevent a first person in a bed from disturbing another.

Lastly, it is an object of the present invention to provide a new and improved bed blanket for bed including a pair of blankets of fabric each having a top surface, a bottom surface, and a periphery formed therebetween. The periphery of each blanket is defined by a linear first side edge of a predetermined length, a linear top edge perpendicular with respect to the first side edge, a linear bottom edge perpendicular with respect to the first side edge, and a second side edge including a top extent perpendicular with respect to the top edge. The top extent has a length of about ¾ the predetermined length. A bottom extent of the second side edge is perpendicular with respect to the bottom edge and has a length of about ¼ the predetermined length. Also included is a pair of seams each including a thin strip secured about the entire periphery of the associated blanket. The bottom extent of the second side edge of each blanket are fixedly coupled together along an entire length thereof such that the top extent of the second side edges of the blankets overlap freely.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
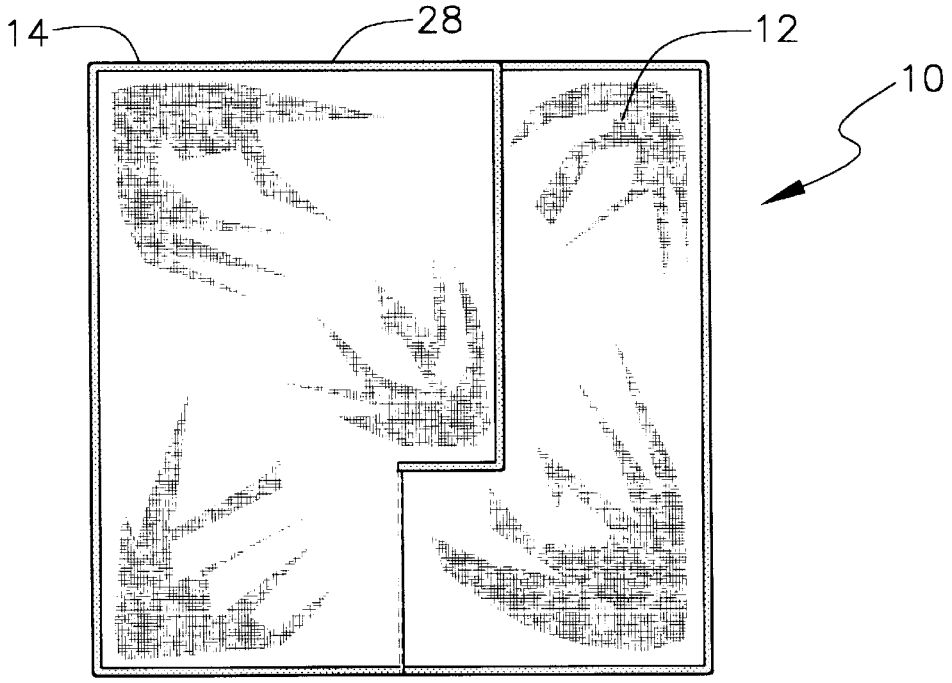
FIG. 1 is an illustration of the preferred embodiment of the bed blanket for bed constructed in accordance with the principles of the present invention.
Figure 2:
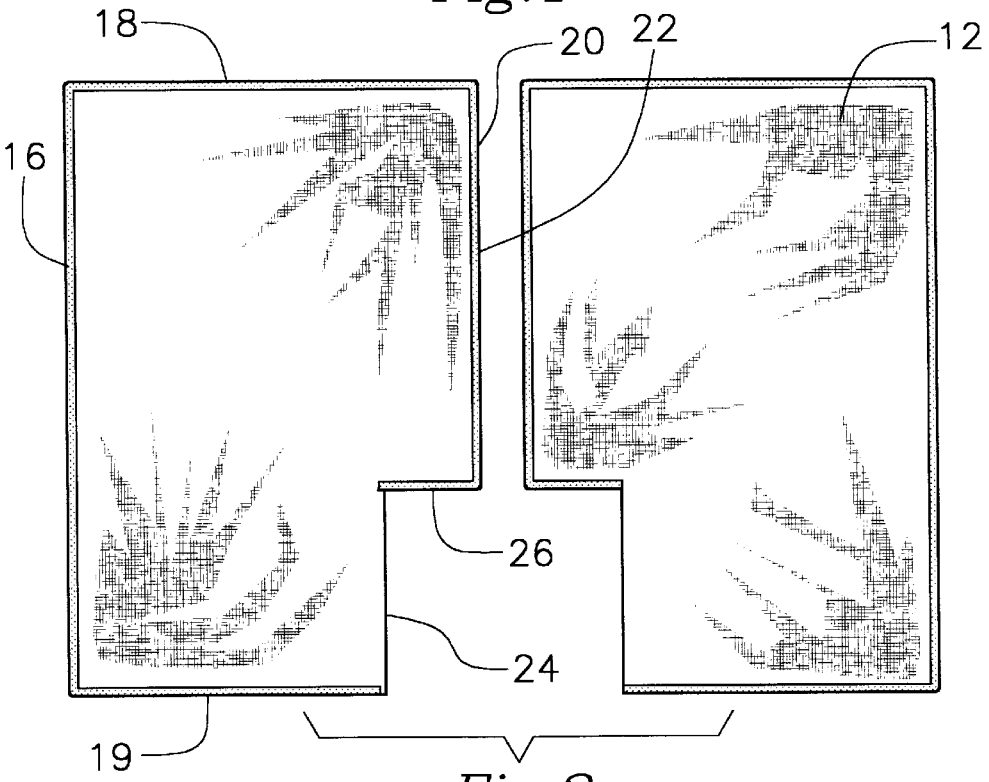
FIG. 2 is a top view of the blankets separated.
Figure 3:
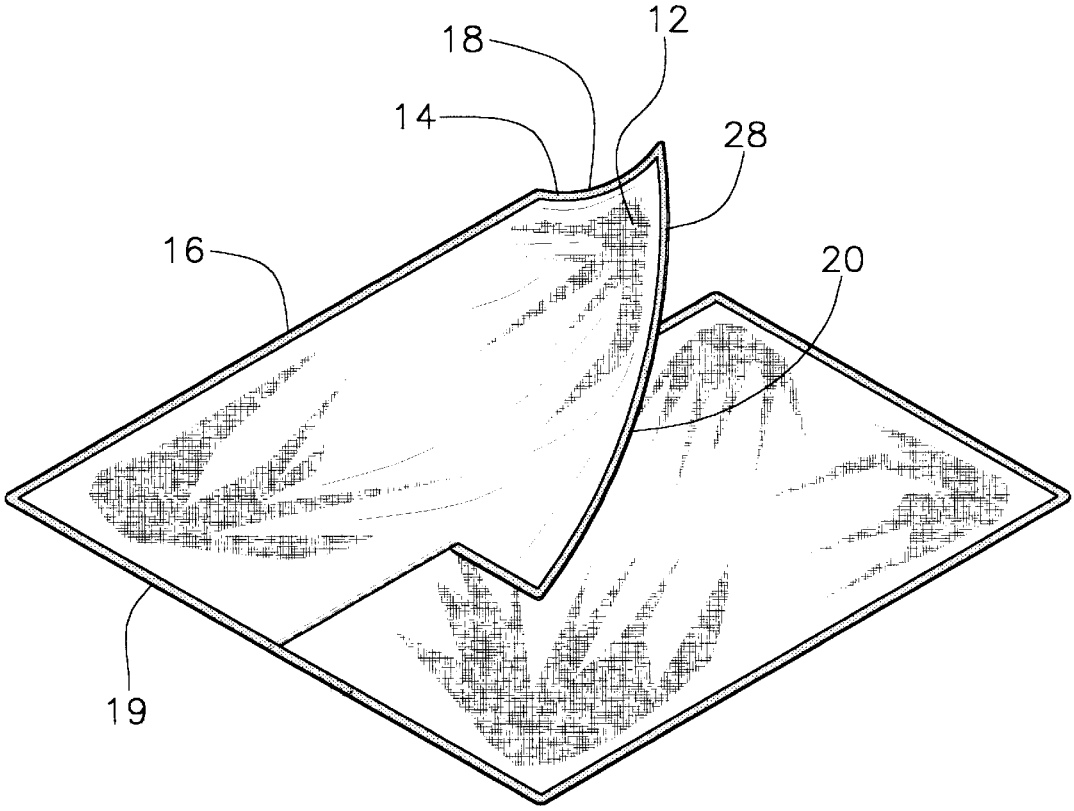
FIG. 3 is a perspective view of the blankets in an operative orientation.

With reference now to the drawings, and in particular to FIG. 1 thereof, a new and improved bed blanket for bed embodying the principles and concepts of the present invention and generally designated by the reference numeral 10 will be described.

The present invention, the new and improved bed blanket for bed, is comprised of a plurality of components. Such components in their broadest context include a pair of blankets. Such components are individually configured and correlated with respect to each other so as to attain the desired objective.

More specifically, it will be noted that the system 10 of the present invention includes a pair of blankets of cotton fabric 12. Each blanket has a top surface, a bottom surface, and a periphery 14 formed therebetween.

The periphery of each blanket is defined by a linear first side edge 16 of a predetermined length and a linear top edge 18 perpendicular with respect to the first side edge and having a length of about ¾ the predetermined length. The periphery is further defined by a linear bottom edge 19 perpendicular with respect to the first side edge and having a length about ½ the predetermined length.

Lastly, a second side edge 20 of the periphery includes a top extent 22 perpendicular with respect to the top edge and having a length of about ¾ the predetermined length. A bottom extent 24 of the second side edge is perpendicular with respect to the bottom edge and has a length of about ¼ the predetermined length. Extending between a bottom of the top extent and a top of the bottom extent of the second side eage is an intermediate extent 26 of a length ¼ the predetermined length. Such intermediate extent of the second side resides in parallel with the top and bottom edges. In the preferred embodiment, the intermediate extent is 12 inches for a queen sized bed and 18 inches for a king sized bed.

Further provided is a pair of durable nylon seams 28 each including a thin strip. This strip is secured about the entire periphery of the associated blanket with the exception of the bottom extent of the second side edge. Preferably, the strip is folded to encompass the top surface and bottom surface of the corresponding blanket.

As shown in FIG. 1, the bottom extent of the second side edge of each blanket are stitchedly coupled together along an entire length thereof. As such, the top extent of the second side edges of the blankets overlap freely.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bed blanket for bed comprising, in combination:

a pair of blankets of fabric each having a top surface, a bottom surface, and a periphery formed therebetween, the periphery of each blanket defined by a linear first side edge of a predetermined length, a linear top edge perpendicular with respect to the first side edge and having a length of about ¾ the predetermined length, a linear bottom edge perpendicular with respect to the first side edge and having a length about ½ the predetermined length, and a second side edge including a top extent perpendicular with respect to the top edge and having a length of about ¾ the predetermined length and a bottom extent perpendicular with respect to the bottom edge and having a length of about ¼ the predetermined length, wherein an intermediate extent of a length ¼ the predetermined length extends between a bottom of the top extent and a top of the bottom extent of the second side edge and resides in parallel with the top and bottom edges; and a pair of seams each including a thin strip secured about the entire periphery of the associated blanket with the exception of the bottom extent of the second side edge and folded to encompass the top surface and bottom surface of the corresponding blanket;

said bottom extent of the second side edge of each blanket being stichedly coupled together along an entire length thereof such that the top extent of the second side edges of the blanket overlap freely, and each intermediate extent being horizontal and unstitched to the adjacent intermediate extent except for a vertical stitch line there beneath.

* * * * *